US012768225B2

(12) United States Patent
Fuller

(10) Patent No.: US 12,768,225 B2
(45) Date of Patent: Oct. 20, 2026

(54) BIT ASSEMBLY

(71) Applicant: Andrew Corbin Fuller, Ridgeville, SC (US)

(72) Inventor: Andrew Corbin Fuller, Ridgeville, SC (US)

(73) Assignee: Andrew Corbin Fuller, Ridgeville, SC (US)

( * ) Notice: Subject to any disclaimer, the term of this patent is extended or adjusted under 35 U.S.C. 154(b) by 84 days.

(21) Appl. No.: 18/904,458

(22) Filed: Oct. 2, 2024

(65) Prior Publication Data

US 2026/0092500 A1 Apr. 2, 2026

(51) Int. Cl.

| | |
|---|---|
| ***E21B 10/42*** | (2006.01) |
| ***E02D 5/28*** | (2006.01) |
| ***E02D 5/36*** | (2006.01) |
| ***E02D 5/56*** | (2006.01) |

(52) U.S. Cl.
CPC ..... *E21B 10/42* (2013.01); *E02D 5/285* (2013.01); *E02D 5/56* (2013.01)

(58) Field of Classification Search
CPC ..... E21B 10/42; E02D 5/285; E02D 5/56
See application file for complete search history.

(56) References Cited

U.S. PATENT DOCUMENTS

| | | | |
|---|---|---|---|
| 2,983,345 | A | 5/1961 | Langer |
| 3,645,055 | A | 2/1972 | Roza |
| 3,680,274 | A | 8/1972 | Deike |
| 4,650,372 | A | 3/1987 | Gorrell |
| 5,066,168 | A | 11/1991 | Holdeman |
| 5,122,013 | A | 6/1992 | Junsheng et al. |
| 5,575,122 | A | 11/1996 | Hamilton |
| 5,707,180 | A | 1/1998 | Vickars et al. |
| 6,058,662 | A | 5/2000 | Perko |
| 6,264,402 | B1 | 7/2001 | Vickars |
| 6,368,021 | B1 | 4/2002 | Strong et al. |
| 6,652,195 | B2 | 11/2003 | Vickars et al. |

(Continued)

FOREIGN PATENT DOCUMENTS

| | | | |
|---|---|---|---|
| CN | 104763328 | B | 3/2017 |
| CN | 113202100 | A | 8/2021 |

(Continued)

OTHER PUBLICATIONS

Machine translation of Japanese Patent Application No. 1-244015 (18 pages).

(Continued)

*Primary Examiner* — Amber R Anderson
*Assistant Examiner* — Sracy N Lawson
(74) *Attorney, Agent, or Firm* — Thrive IP®; Jeremy M. Stipkala; Olivia Wozniak

(57) ABSTRACT

A bit assembly for a construction pile comprises a plurality of blades, each blade having at least one tooth;

a lower pipe securing each blade in the plurality of blades;

an upper pipe securing each blade in the plurality of blades; wherein the lower pipe and the upper pipe define a gap between them suitable for at least one blade in the plurality of blades to engage one or more driving fasteners of the construction pile. Also disclosed are methods of making such bit assemblies, methods of making piles with such bit assemblies, and piles including such bit assemblies.

19 Claims, 4 Drawing Sheets

© 2024 Andrew Corbin Fuller

(56) References Cited

U.S. PATENT DOCUMENTS

| | | | | |
|---|---|---|---|---|
| 6,722,821 | B1 | 4/2004 | Perko | |
| 6,814,525 | B1 | 11/2004 | Whitsett | |
| 7,314,335 | B2 | 1/2008 | Whitsett | |
| 7,416,367 | B2 | 8/2008 | St. Onge | |
| 7,494,299 | B1 | 2/2009 | Whitsett | |
| 7,546,887 | B2 | 6/2009 | Schwab | |
| 7,854,451 | B2 | 12/2010 | Davis | |
| 8,033,757 | B2 | 10/2011 | Stroyer | |
| 8,506,207 | B2 | 8/2013 | Lutenegger et al. | |
| 8,613,571 | B1 | 12/2013 | Watson, III | |
| 8,926,228 | B2 | 1/2015 | Stroyer | |
| 9,051,706 | B1 | 6/2015 | Ludwig | |
| 9,181,674 | B2 | 11/2015 | El Naggar | |
| 9,631,335 | B2 | 4/2017 | Reusing et al. | |
| 10,024,020 | B2 | 7/2018 | Fuller | |
| 10,392,768 | B2 | 8/2019 | Kemp | |
| 11,851,839 | B1 | 12/2023 | Fuller | |
| 12,516,484 | B1 | 1/2026 | Fuller | |
| 2003/0159839 | A1 | 8/2003 | Perko | |
| 2006/0051183 | A1 | 3/2006 | Powell | |
| 2007/0286686 | A1 | 12/2007 | Lindsey | |
| 2008/0128174 | A1 | 6/2008 | Radford et al. | |
| 2009/0114448 | A1 | 5/2009 | Laird et al. | |
| 2012/0037261 | A1 | 2/2012 | Nagata | |
| 2012/0114425 | A1 | 5/2012 | Seider et al. | |
| 2014/0079491 | A1* | 3/2014 | Foster | E02D 29/00 405/252.1 |
| 2015/0117960 | A1 | 4/2015 | Kemp et al. | |
| 2015/0233075 | A1 | 8/2015 | Maggio | |
| 2015/0345098 | A1 | 12/2015 | Song | |
| 2016/0251819 | A1 | 9/2016 | Dinh | |
| 2017/0198453 | A1 | 7/2017 | Brown | |
| 2018/0155893 | A1 | 6/2018 | Fuller | |
| 2018/0258602 | A1 | 9/2018 | Kemp | |
| 2019/0271131 | A1 | 9/2019 | Perko | |
| 2019/0324007 | A1 | 10/2019 | Dugard | |
| 2025/0109563 | A1 | 4/2025 | Fuller | |

FOREIGN PATENT DOCUMENTS

| | | | | |
|---|---|---|---|---|
| CN | 221345564 | U | 7/2024 | |
| CN | 118704902 | | 9/2024 | |
| GB | 2418949 | A | 4/2006 | |
| JP | 1-244015 | A | 9/1989 | |
| WO | WO-9914441 | A1 * | 3/1999 | E02D 27/42 |
| WO | WO-2018076054 | A1 * | 5/2018 | E02D 7/22 |

OTHER PUBLICATIONS

Timothy W. Mays, Ph.D., P.E. and Ryan Keiper, P.E.; Grout Volume During Placement, Fuller PileTM Technical Note 1-22 (2022) (2 pages).

Timothy W. Mays, Ph.D., P.E.; Fuller Pile Head Connection Detailing, Fuller PileTM Technical Note 2-22 (2022) (2 pages).

Timothy W. Mays, Ph.D., P.E.; Fuller Pile Specialty and Residential Head Details, Fuller PileTM Technical Note 3-22 (2022) (2 pages).

Timothy W. Mays, Ph.D., P.E. and Ryan Keiper, P.E.; Elevated Design Using Continuous Fuller Pile-Column Elements Without the Need for Grade Beams or Lateral Support Elements at Grade; Fuller PileTM Technical Note 7-23 (2023) (2 pages).

Unpublished U.S. Appl. No. 18/106,618, filed Feb. 7, 2023 (44 pages).

Unpublished U.S. Appl. No. 18/479,448, filed Oct. 2, 2023 (38 pages).

Machine translation of Chinese Patent Application No. 104763328 B (13 pages).

Machine translation of Chinese Patent Application No. 113202100 A (8 pages).

Machine translation of Chinese Patent Application No. 221345564 U (6 pages).

Machine translation of Chinese Patent Application No. 118704902 (11 pages).

International Search Report for PCT/US2025/048907 dated Dec. 18, 2025 (3 pages).

Written Opinion for PCT/US2025/048907 dated Dec. 18, 2025 (6 pages).

* cited by examiner

© 2024 Andrew Corbin Fuller

© 2024 Andrew Corbin Fuller

© 2024 Andrew Corbin Fuller

© 2024 Andrew Corbin Fuller

BIT ASSEMBLY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to bits useful for construction piles for establishing foundations in a variety of soil types.

BACKGROUND OF THE INVENTION

Construction piles are known. Applicant has innovated and brought to market a significant contribution using piles to strengthen soils, such as sedimentary soils deeply covering supporting bedrock. Some such soils exist where people want to build houses, hotels, and other buildings: near bodies of water and in flood planes where such soil cannot be considered the most stable. Yet construction piles in such soils make it reasonable to build in those locations.

Bits that can be used advantageously with construction piles are known as well. Applicant has secured U.S. Pat. No. 10,024,020 relating to the use of bits with construction piles. U.S. Pat. No. 10,024,020 is incorporated herein by reference in its entirety.

However, difficulties arise with known bits and piles. Under the high stresses involved with placing a pile deep in soil, some bits have been observed to bend or tilt, thereby decreasing the performance of such bits and hindering the stable and predictable installation of piles with those bits. The dimensions of the holes formed, and the amounts of grout consumed, become unpredictable. Worse, the performance of the completed pile becomes suspect when its installation differs dramatically from its design.

Further, known bits are labor intensive and material intensive to manufacture. Applicant has observed the need for multiple welds and considerable amounts of material to form certain known bits. Strong-enough bits using less material and taking less labor to manufacture are needed.

SUMMARY OF THE INVENTION

Unexpectedly, Applicant has invented new bit assemblies to use in the installation of construction piles. Certain embodiments of those new bit assemblies may use dramatically less material and require far fewer welds or similar attachment efforts than previous bits. Certain further embodiments, because of a greater simplicity of design, may be manufactured much more quickly, even by robotic tools designed for that manufacture. Still other embodiments may exhibit dramatically less deformation or tilting during installation, resulting in predictable performance manifest by uniform grout consumption, pile after pile. Such innovations are not predicted by a review of the state of the art.

Accordingly, Applicant has invented bit assemblies, one such bit assembly for a construction pile comprising a plurality of blades, a lower pipe securing each blade in the plurality of blades, an upper pipe also securing each blade in the plurality of blades, wherein the lower pipe and the upper pipe define a gap between them suitable for at least one blade in the plurality of blades to engage one or more driving fasteners of the construction pile. With this assembly, a pile can be inserted or parts of the pile joined together within the bit assembly, and the bolt or bolts of that pile can function as driving fasteners to turn the pile and bit assembly in soil, allowing the installation of the pile in the soil.

Further aspects of the present invention include methods of manufacturing a bit assembly one such method comprising obtaining a plurality of blades, each blade in the plurality of blades comprising a lower end opposite an upper end, an inside edge between the lower end and the upper end, and an outside edge opposite the inside edge;

obtaining a lower pipe having a first outer diameter, a first inner diameter, and a first length;

obtaining an upper pipe having a second outer diameter, a second inner diameter, and a second length;

attaching each blade in the plurality of blades at the inside edge proximal to the lower end to the lower pipe, and at the inside edge proximal to the upper end to the upper pipe; thereby manufacturing the bit assembly.

Additional aspects relate to a blade for a bit assembly for a construction pile, the blade comprising: a lower end opposite an upper end; an inside edge between the lower end and the upper end; and an outside edge opposite the inside edge; the outside edge having at least one tooth. A tooth, as used herein, is a projection of whatever shape and dimension from the blade to engage the soil. Often a tooth or more teeth can form grooves in the soil as the bit assembly is rotated and driven into the soil.

Other aspects of the present invention include methods for constructing a pile with a bit assembly, one such method comprising: obtaining the bit assembly comprising a plurality of blades, each blade comprising a lower end opposite an upper end, an inside edge between the lower end and the upper end, and an outside edge opposite the inside edge; a lower pipe having a first outer diameter securing each blade in the plurality of blades proximal to the lower end and at the inside edge; an upper pipe having a second outer diameter securing each blade in the plurality of blades proximal to the upper end and at the inside edge; wherein the lower pipe and the upper pipe define a gap between them suitable for at least one blade in the plurality of blades to engage one or more driving fasteners of the construction pile;

placing a first part of the pile into the bit assembly through the lower pipe; placing a second part of the pile into the bit assembly through the upper pipe; joining the first part of the pile with the second part of the pile with the one or more driving fasteners at the gap, thereby constructing the pile with the bit assembly.

Yet additional aspects of the present invention involve piles in soil, one such pile comprising a bit assembly comprising a plurality of blades, each blade comprising a lower end opposite an upper end; an inside edge between the lower end and the upper end; and an outside edge opposite the inside edge;

a lower pipe having a first outer diameter securing each blade in the plurality of blades proximal to the lower end and at the inside edge; an upper pipe having a second outer diameter securing each blade in the plurality of blades proximal to the upper end and at the inside edge; wherein the lower pipe and the upper pipe define a gap between them suitable for at least one blade in the plurality of blades to engage one or more driving fasteners of the construction pile.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
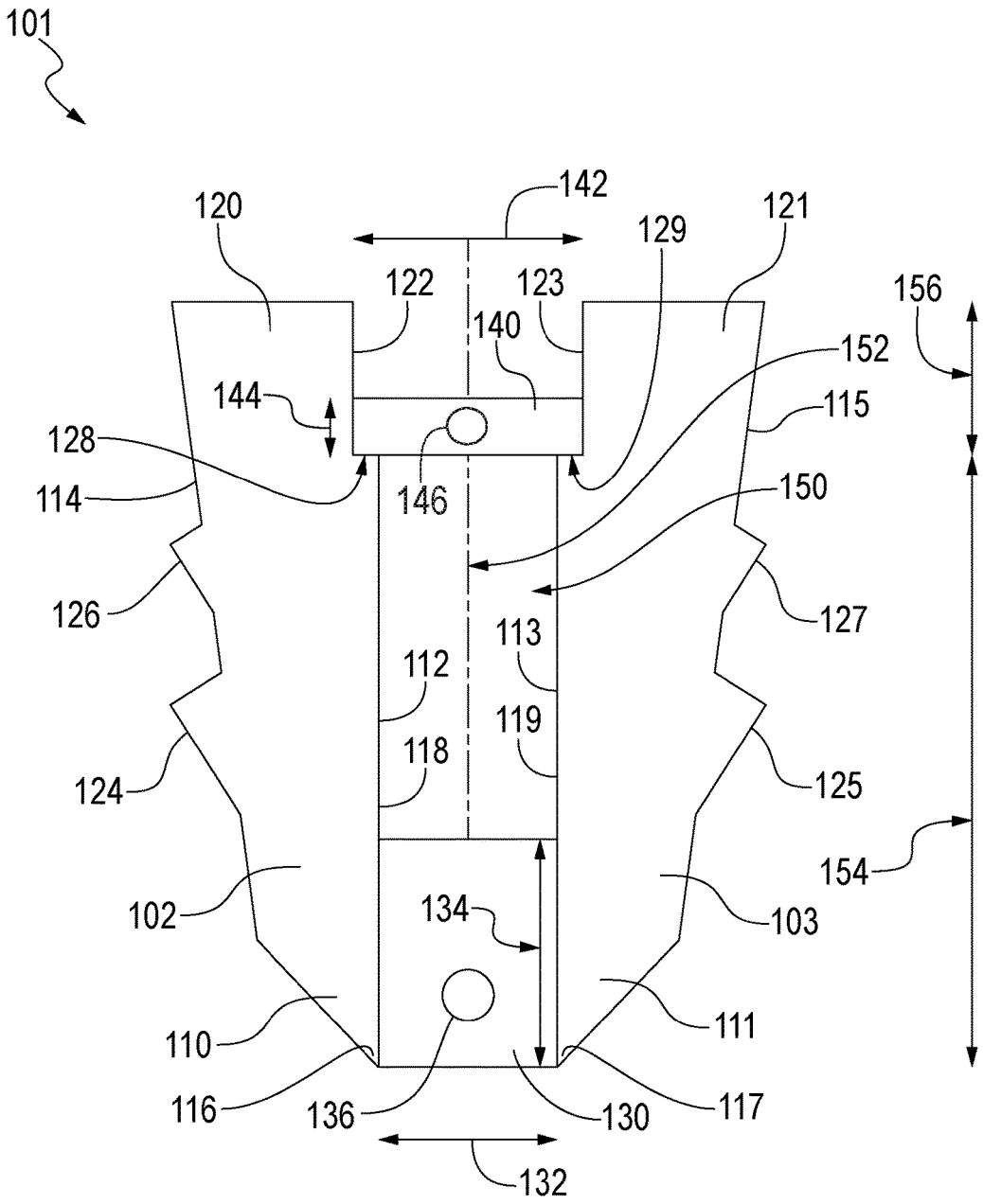
FIG. 1 depicts one embodiment of the invention comprising bit assembly 101.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this disclosure prevail unless stated otherwise.

Wherever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

Certain instances of the present invention include a bit assembly for a construction pile comprising a plurality of blades, a lower pipe securing each blade in the plurality of blades, and an upper pipe also securing each blade in the plurality of blades, wherein the lower pipe and the upper pipe define a gap between them suitable for at least one blade in the plurality of blades to engage one or more driving fasteners of the construction pile. Any suitable number of blades can form the plurality of blades. Two, 3, 4, 5, 6, or more than six blades can be used. In addition, the blades need not be identical to other blades in the plurality. However, in some cases, a bit assembly of the present invention is easier to manufacture than the bits of the current state of the art. For example, a bit assembly of the present invention may require fewer welds or other attachment steps to manufacture than known bits.

Other instances of the present invention provide for a bit assembly for a construction pile comprising: a plurality of blades, each blade comprising a lower end opposite an upper end; an inside edge between the lower end and the upper end; and an outside edge opposite the inside edge; wherein the inside edge has a first section proximal to the lower end, and a second section proximal to the upper end; the outside edge having at least one tooth; a lower pipe having a first outer diameter securing each blade in the plurality of blades proximal to the lower end and at the first section of the inside edge; an upper pipe having a second outer diameter securing each blade in the plurality of blades proximal to the upper end and at the second section of the inside edge; wherein the lower pipe and the upper pipe define a gap between them suitable for at least one blade in the plurality of blades to engage one or more driving fasteners of the construction pile. The first outer diameter and the second outer diameter can be the same or different, and are independently chosen. In some cases, the first outer diameter is less than the second outer diameter. In other cases, the first outer diameter is greater than the second outer diameter. When the first outer diameter differs from the second outer diameter, it can be said that there is a step between the first section and the second section of the inside edge of the blade. That step can take any suitable geometry. In some cases, this step can take the form of a gradual change in dimension in the region of the gap from where the lower pipe attaches to the blade to where the upper pipe attaches to the blade. In other cases, the step occurs at substantially right angles to the first section and the second section.

The bit assembly can have any suitable dimensions. As can be appreciated, the bit assembly may be dimensioned by reference to the pile to which it attaches. A larger pile will require a larger bit assembly. In some cases, the lower pipe has a first inner diameter, and the upper pipe has a second inner diameter, and the first inner diameter and the second inner diameter are both large enough to receive the construction pile within the lower pipe and the upper pipe. The first inner diameter of the lower pipe will be less than the first outer diameter. The second inner diameter of the upper pipe with be less than the second outer diameter. Accordingly, the upper pipe and the lower pipe have pipe wall thicknesses of any suitable dimensions. For example, pipe wall thicknesses can be about an eighth of an inch, about a quarter of an inch, about a half of an inch, about three quarters of an inch, about an inch, about two inches, about four inches, or about six inches, or more than about six inches. The pipe wall thicknesses of the lower pipe and the upper pipe are independently chosen.

The lower pipe and the upper pipe can have any suitable cross section geometry, and are independently chosen. Circular pipe may be mentioned. Square, elliptical, triangular, rectangular, and polygonal may be mentioned. When discussing pipe having other than a circular geometry, "diameter" means the greatest dimension across the pipe.

Referring to the outer dimensions of the pipe, the first outer diameter can be more than about 1 inch, more than about 2 inches, more than about 3 inches, more than about 4 inches, more than about 6 inches, more than about 1 foot, more than about 2 feet, more than about 3 feet, more than about 5 feet, more than about 10 feet, or more than about 12 feet. In another example, the first outer diameter can be less than about 1 inch, less than about 2 inches, less than about 3 inches, less than about 4 inches, less than about 6 inches, less than about 1 foot, less than about 2 feet, less than about 3 feet, less than about 5 feet, less than about 10 feet, or less than about 12 feet. For another example, the first outer diameter can be about 3.5 inches.

The second outer diameter is chosen independently of the first outer diameter. For example, the second outer diameter can be more than about 1 inch, more than about 2 inches, more than about 3 inches, more than about 4 inches, more than about 6 inches, more than about 1 foot, more than about 2 feet, more than about 3 feet, more than about 5 feet, more than about 10 feet, or more than about 12 feet. In another example, the second outer diameter can be less than about 1 inch, less than about 2 inches, less than about 3 inches, less than about 4 inches, less than about 6 inches, less than about 1 foot, less than about 2 feet, less than about 3 feet, less than about 5 feet, less than about 10 feet, or less than about 12 feet. In an additional example, the second outer diameter is about 4.5 inches.

A bit assembly can have any suitable length. Additional instances provide a lower pipe having a first length, an upper pipe having a second length, and the inside edge of the blade has an inside edge length that is greater than the first length and the second length combined. This means the blade is longer than the lower pipe and the upper pipe measured together. In some cases, the first length of the lower pipe is more than about 1 inch, more than about 2 inches, more than about 3 inches, more than about 4 inches, more than about 6 inches, more than about 1 foot, more than about 2 feet, more than about 3 feet, or more than about 5 feet. In another example, the first length can be less than about 1 inch, less than about 2 inches, less than about 3 inches, less than about 4 inches, less than about 6 inches, less than about 1 foot, less than about 2 feet, less than about 3 feet, or less than about 5 feet. In certain examples of the present invention, the first length is about 4 inches.

In other cases, the second length of the upper pipe is more than about 1 inch, more than about 2 inches, more than about 3 inches, more than about 4 inches, more than about 6 inches, more than about 1 foot, more than about 2 feet, more than about 3 feet, or more than about 5 feet. In another example, the second length can be less than about 1 inch, less than about 2 inches, less than about 3 inches, less than about 4 inches, less than about 6 inches, less than about 1 foot, less than about 2 feet, less than about 3 feet, or less than about 5 feet. In other examples, the second length is about 1 inch.

The blades of a bit assembly need not be identical. However, for ease of manufacture, it may be easier to choose a single design for the blades, so the blades of a bit assembly differ only due to slight manufacturing flaws, in some cases. A blade of the present invention can have any suitable dimensions. The inside edge of the blade, which contacts the lower pipe, the upper pipe, and allows for a gap between the lower pipe and the upper pipe, can have any suitable length. In some cases, the inside edge length is more than about six inches, more than about 1 foot, more than about 2 feet, more than about 3 feet, more than about 6 feet, or more than about 10 feet. In other cases, the inside edge length is more than about six inches, less than about 1 foot, less than about 2 feet, less than about 3 feet, less than about 6 feet, or less than about 10 feet. Still other cases provide an inside edge length that is about 15 inches.

It should be pointed out that the lower end and the upper end of a blade can have any suitable position relative to the lower pipe and the upper pipe. In some cases, the lower pipe and the blade are co-terminal. That is, they both align. But that is not required. The lower pipe can extend below the lower end of the blade, or the lower end of the blade can extend below the lower pipe. Similarly, the upper end of the blade can be co-terminal with the upper pipe, or either the blade or the upper pipe can extend above the other.

The blade also can have any suitable geometry. For example, the lower end of each blade in the plurality of blades may taper to a point proximal to the inside edge. Such a taper can begin at any suitable point on the blade. In some instances, the lower end begins to taper to the point about one inch, about 2.5 inches, about 4 inches, about 6 inches, or about 1 foot from the point. That means the outside edge begins to come closer to the inside edge as the outside edge comes closer to the lower end.

It follows that the parts of the blade and of the bit assembly can have any suitable dimension. The first section, which attaches to the lower pipe and may contain the gap, in certain instances, has a first section length of more than about four inches, more than about 1 foot, more than about 2 feet, more than about 3 feet, more than about 5 feet, or more than about 8 feet. In other cases, the inside edge length is more than about four inches, less than about 1 foot, less than about 2 feet, less than about 3 feet, less than about 5 feet, or less than about 8 feet. Further examples provide a first section length of about 12 inches.

The second section, which attaches to the upper pipe and may contain the gap, in certain instances, has a second section length of more than about two inches, more than about 1 foot, more than about 2 feet, more than about 3 feet, more than about 4 feet, or more than about 7 feet. In other cases, the inside edge length is more than about two inches, less than about 1 foot, less than about 2 feet, less than about 3 feet, less than about 4 feet, or less than about 7 feet. Still other examples provide a second section length of about 3 inches.

In some cases, the inside edge has a first section proximal to the lower end, and a second section proximal to the upper end and a step between the first section and the second section. As stated before, the step can assume any suitable geometry. In some instances of the present invention, a step is substantially perpendicular to the first section and the second section. In further instances, a step defines a step distance between the first section and the second section. A step distance can be more than about a quarter of an inch, more than about a half of an inch, more than about an inch, more than about 2 inches, more than about six inches, or more than about a foot. Or, a step distance can be less than about a quarter of an inch, less than about a half of an inch, less than about an inch, less than about 2 inches, less than about six inches, or less than about a foot. In certain cases, a step distance is about half an inch.

The parts of the bit assembly can have any suitable features. Those features can be present to assist manufacture, assembly, and/or installation. In certain examples, a bit assembly can feature a lower pipe having at least one fastener hole through a diameter of the lower pipe. That can assist in some embodiments with joining the bit assembly with a pile by passing a joining fastener such as a bolt through the fastener hole and through the pile, so that turning the pile also turns the bit assembly in the soil. Similarly, and independently, an upper pipe may have at least one fastener hole through a diameter of the upper pipe.

In certain embodiments, a blade of the present invention has at least one tooth. A tooth is a projection of any suitable geometry and dimension extending from the outside edge of the blade to engage the soil. In some cases, a tooth can create a groove in the soil as the pile and bit assembly are turned and driven into the soil. A blade can have one, 2, 3, 4, 5, 6, or more than six teeth on its outside edge. Some cases provide a blade having two teeth. The teeth can appear at any suitable location on the outside edge of the blade. Certain examples provide a tooth or teeth opposite the gap between the lower pipe and the upper pipe. Or, the at least one tooth appears on the outside edge opposite the first section of the inside edge. In still other circumstances, at least one tooth can appear on the outside edge opposite the second section.

The parts of the bit assembly can be arranged in any suitable relationship. In some cases, the lower pipe and the upper pipe are coaxial. That means the major axis of each pipe, parallel to its length and centrally located within the pipe, align and are co-linear.

Other aspects of the present invention relate to methods of manufacturing a bit assembly. One such method includes obtaining a plurality of blades, each blade in the plurality of blades comprising a lower end opposite an upper end, an inside edge between the lower end and the upper end, and an outside edge opposite the inside edge. In certain instances, the blades can be substantially identical for ease of manufacturing. In other instances, the blades can be differently shaped, as desired. The method further includes obtaining a lower pipe having a first outer diameter, a first inner diameter, and a first length, and obtaining an upper pipe having a second outer diameter, a second inner diameter, and a second length. Then, each blade in the plurality of blades is attached at the inside edge proximal to the lower end to the lower pipe, and at the inside edge proximal to the upper end to the upper pipe, thereby manufacturing the bit assembly.

Further aspects of the present invention relate to blades for a bit assembly for a construction pile. One such blade includes a lower end opposite an upper end, an inside edge between the lower end and the upper end, and an outside edge opposite the inside edge, and the outside edge has at least one tooth. The geometry of teeth can be chosen for ease of manufacture. Or the geometry of teeth can be chosen for the shape of the groove they might form in soil. An angular tooth might create an angular-walled groove in the soil as the pile and bit assembly are driven into it. A tooth having a curved or arcuate geometry might create a rounded groove in the soil.

A bit assembly can be attached to a pile in any suitable manner. For example, bit assemblies can be attached to a pile lead section at a factory. Or bit assemblies can be attached to an extension section for a pile at a factory. Or, a bit assembly can be included with a pile as the pile is assembled at a factory or in the field just before installation. Attachment can happen by any suitable method. Welding, casting, bolting, and molding may be used individually or in combination. In some cases, driving fasteners such as bolts can join parts of a pile together at the gap between the lower pipe and the upper pipe. The driving fasteners can be secured in place with nuts. Then, when the pile is turned, the driving fasteners contact at least one blade and turn the bit assembly with the pile.

Accordingly, one method for constructing a pile with a bit assembly includes obtaining any of the bit assemblies as described herein, placing a first part of the pile into the bit assembly through the lower pipe, placing a second part of the pile into the bit assembly through the upper pipe, joining the first part of the pile with the second part of the pile with the one or more driving fasteners at the gap, thereby constructing the pile with the bit assembly. To position the bit assembly just after the portion of the pile that first penetrates the soil, in some cases, the first part of the pile entering the lower pipe is a lead section. Optionally, the second part of the pile entering the upper pipe is an extension section.

Piles, and the parts thereof, can have any suitable dimensions and geometries. For example, the first part of the pile may have a top end having a top end outer diameter, and the second part comprises a bottom end having a bottom end inner diameter. In certain instances, wherein the bottom end inner diameter is wider than the top end outer diameter. Depending on the size of the pile needed, the pile part dimensions are chosen. For example, the top end outer diameter may be about 2 and ⅞ inches. For another example, the bottom end of the second part has a bottom end inner diameter that may be less than about 4 inches.

Further aspects of the present invention relate to a pile in soil comprising a bit assembly having a plurality of blades, each blade comprising a lower end opposite an upper end, an inside edge between the lower end and the upper end, and an outside edge opposite the inside edge, a lower pipe having a first outer diameter securing each blade in the plurality of blades proximal to the lower end and at the inside edge, an upper pipe having a second outer diameter securing each blade in the plurality of blades proximal to the upper end and at the inside edge, wherein the lower pipe and the upper pipe define a gap between them suitable for at least one blade in the plurality of blades to engage one or more driving fasteners of the construction pile. Such a pile may also include hardened grout supporting the pile in the soil. Such a pile may also include other features, such as a rebar cage as a reinforcing structure, and/or to tie in structure built above the pile and supported by the pile.

Certain instances of the present invention provide methods for constructing a pile in soil, one such method comprising driving a lead section comprising a flight of helical screws between a top end and a bottom end of the lead section into the soil, thereby forming a hole in the soil about the lead section. Optionally, the hole may be partially pre-dug as with an auger to remove at least some soil before the lead section contacts the soil. To drive the lead section, it is joined to a driving section that applies force to the lead section, such as a rotational force, a vertical insertion force, or a combination thereof. One or more extension sections may be added between the lead section and the driving section, wherein the one or more extension sections are joined at a lower end to the lead section and are joined at an upper end to the driving section. At the top end of the lead section where the driving section or first extension section is joined, a bit assembly of the present invention can be added so that the joining fasteners, typically bolts secured with nuts, that hold the lead section and the driving section or first extension section can contact one or more blades of the bit assembly as the pile is rotated and driven into the soil.

The lead section can have any suitable dimensions. For example, the cross section of the lead section excluding the helical screws can have a lead section diameter that is at least about 2 inches, at least about 3 inches, at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, or at least about 20 inches. If the lead section has a cross-section other than circular, "lead section diameter" then refers to the largest diameter of the cross section of the lead section excluding the helical screws. In further examples, a lead section diameter can be no more than about 3 inches, no more than about 4 inches, no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, or no more than about 20 inches.

A lead section can have any suitable length. For example, the lead section can have a length from the top end to the bottom end of at least about 2 feet. For another example, the lead section has a length from the top end to the bottom end of no more than about 30 feet.

Any suitable helixes can appear in the flight of helical threads. In some cases, the flight of helical threads comprises a single continuous thread. In other cases, the flight of helical threads comprises more than one continuous thread, such as two or three continuous threads. As used herein, a "continuous thread" indicates a helix that wraps around the lead section for more than 360 degrees. Further cases provide a flight of helical threads that comprises a plurality of distinct helixes. A "distinct helix" wraps around the lead section for 360 degrees or less. Still further cases allow a flight of helical threads to include any suitable combination of continuous threads and distinct helixes. Helical threads can extend from the shaft of the lead section any suitable distance. In some cases, helical threads extend at least one inch. In other cases, the helical threads extend no more than two feet.

The bit assembly may be coupled to the pile in any suitable manner. Joining fasteners such as bolts may be positioned in the gap of the bit assembly to cause it to rotate as the lead section is rotated, thereby engaging the soil. Those joining fasteners also prevent the bit assembly from sliding up or otherwise disengaging from the soil. Or, in other instances, the bit may be welded or otherwise secured to appropriate structure, such as the top end of the lead section, or to an adjacent portion of an extension section.

A pile can extend from the surface into the soil any suitable depth. Additional extension sections can be added to the pile above the lead section and the bit assembly to accomplish any desirable depth. In some cases, the depth is greater than about 1 foot, greater than about 3 feet, greater than about 5 feet, greater than about 10 feet, greater than about 15 feet, greater than about 20 feet, greater than about 25 feet, greater than about 30 feet, greater than about 40 feet, greater than about 50 feet, greater than about 60 feet, greater than about 75 feet, or greater than about 100 feet. In other cases, the depth is no greater than about 1 foot, no greater than about 3 feet, no greater than about 5 feet, no greater than about 10 feet, no greater than about 15 feet, no greater than about 20 feet, no greater than about 25 feet, no greater than about 30 feet, no greater than about 40 feet, no greater than about 50 feet, no greater than about 60 feet, no greater than about 75 feet, or no greater than about 100 feet. An extension section usually is a length of pipe ranging from 5 feet to 20 feet that connects the driving section to the lead section.

Certain methods involve adding liquid grout to the hole. Liquid grout can be added in any suitable manner, and at any suitable time. Sometimes, at least some of the liquid grout is added during the driving the lead section.

A pile of the present invention can have any suitable dimensions. For example, a pile can have a pile diameter that is no more than about 1 inch, no more than about 2 inches, no more than about 3 inches, no more than about 4 inches, no more than about 6 inches, no more than about 7 inches, no more than about 8 inches, no more than about 9 inches, no more than about 10 inches, no more than about 11 inches, no more than about 12 inches, no more than about 15 inches, no more than about 20 inches, no more than about 24 inches, no more than about 36 inches, no more than about 48 inches, no more than about 60 inches, no more than about 72 inches, or no more than about 120 inches. For another example, a pile may have a pile diameter that is greater than about 1 inch, greater than about 2 inches, greater than about 3 inches, greater than about 4 inches, greater than about 6 inches, greater than about 7 inches, greater than about 8 inches, greater than about 9 inches, greater than about 10 inches, greater than about 11 inches, greater than about 12 inches, greater than about 15 inches, greater than about 20 inches, greater than about 24 inches, greater than about 36 inches, greater than about 48 inches, greater than about 60 inches, greater than about 72 inches, or greater than about 120 inches.

The bit assemblies and piles of the present invention can be manufactured with any suitable materials. In certain instances, a bit assembly is made from steel. Any suitable steel can be used. Stainless steels, carbon steels, and the like may be mentioned. The steel components can be welded together, molded as one, or otherwise attached in any suitable manner. The blades of the bit assemblies can be made from steel, for example, having a thickness ranging from about half-an-inch to up to two inches. The blades can be cast, molded, milled, or cut, or a combination thereof, to form the desired shape. The bit assemblies and piles can exhibit any suitable properties and performance. In some cases, the lead section has a minimum tensile strength of about 50 ksi and a minimum yield strength of about 40 ksi. Optionally, some or all of the metal of the pile is protected from corrosion by being encased in grout, by partial or complete galvanization, or a combination thereof. For example, the lead section, the bit assembly, or both may be galvanized before installation. Suitable galvanization treatments include those known in the art.

Several methods of stabilizing soil using the bit assemblies and piles described herein may be mentioned. Certain of those methods involve driving the pile with a bit assembly into the soil. Driving the pile can include any suitable efforts. In some cases, the pile is pounded, screwed, or pressed into soil, or a combination of such efforts are employed. Optionally, the soil where the pile will go can be opened with an auger and a quantity of soil removed, creating a void in the soil for the pile to enter. Such void can represent substantially the entire volume the pile, or only a portion of that volume. In certain cases, however, no soil is removed, but rather the driving of the pile with the bit assembly compresses the soil around the pile, and the compressed soil aids its stabilization. In a further step, liquid grout can be added to the pile as it has been positioned in the soil, for example, by injecting liquid grout into the lead section or an extension section so the liquid grout flows deep into the pile.

Any suitable liquid grout can be used. Very large rocks in the liquid grout are discouraged, as they could hinder the flow of liquid grout.

Otherwise, concretes such as are known in the art using a suitable cement such as those known as Portland cement can be used as liquid grout, for example. Polymeric grouts may be used in some applications. It is desired that the liquid grout flows along the pile to form solid domains of grout supporting the pile. In some cases, the solid grout forms a solid case of concrete around the pile when installation is complete and the grout has fully cured. In other cases, pouring the liquid grout might not lead to a perfect encasement of the pile by the solidified grout.

As used herein, "soil" indicates any solid material found on Earth with the exception of monolithic rock. Soils may include mud, silt, sand, clay, pebbles, compacted forms of any of those, and combinations thereof. Placing the piles of the present invention in monolithic rock such as bedrock may require pre-formed channels in the rock formed by suitable methods such as those known in the art.

The structures that can be built on the soils stabilized with the bit assembly-equipped piles described herein are not limited. Roads, sidewalks, runways, parking lots, bridge footings, docks, boardwalks, swimming pools, storage tanks, chemical processing equipment such as refineries, windmills, and oil drilling platforms including those deployed at sea, may be mentioned. Foundations for buildings, and the buildings themselves, such as homes, warehouses, factories, office buildings, and the like may be mentioned. Further, at least some of the piles of the present invention can be used to stabilize soil when the only purpose is to stabilize the soil. It may be beneficial to have the soil adjacent a structure be stabilized in the event of flooding or earthquake, and that can be accomplished with piles of the present invention

DETAILED DESCRIPTION OF THE DRAWINGS

Further embodiments of the present invention can be described by reference to the accompanying drawings.

FIG. 1 shows, in one embodiment of the invention, bit assembly 101. Suitable for use with a construction pile, bit assembly 101 comprises blade 102 and blade 103, which together form a plurality of blades. Blade 102 has lower end 110 opposite upper end 120, and inside edge 112 opposite outside edge 114. Blade 102 also has, on inside edge 112 a first section 118 proximal to lower end 110 and a second section 122 proximal to upper end 120. Outside edge 114 has tooth 124 and tooth 126, which are opposite blade 102 from first section 118 of inside edge 112. Blade 103 has lower end 111 opposite upper end 121, and inside edge 113 opposite outside edge 115.

Blade 103 also has, on inside edge 113 a first section 119 proximal to lower end 111 and a second section 123 proximal to upper end 121. Outside edge 115 has tooth 125 and tooth 127, which are opposite blade 103 from first section 119 of inside edge 113.

Bit assembly 101 also has lower pipe 130 having first outer diameter 132 and secures each blade 102, 103 of the plurality blades proximal to the lower ends 110, 111 and at the first sections 118, 119 of the inside edges 112, 113 of blades 102, 103, respectively. Upper pipe 140 has second outer diameter 142 and secures each blade 102, 103 in the plurality blades proximal to the upper ends 120, 121 and at the 2nd sections 122, 123 of inside edges 118, 119 of blades 102, 103, respectively. Lower pipe 130 and upper pipe 140 define a gap 150 between them suitable for at least one blade, 102 or 103, or both, to engage one or more driving fasteners (not shown) of a construction pile (also not shown). Lower pipe 130 and upper pipe 140 are coaxial along axis 152.

First outer diameter 132 is less than second outer diameter 142. Lower pipe 130 has a first length 134. Upper pipe 140 has a second length 144. First sections 118, 119 have a first section length 154. Second sections 122, 123 have a second section length 156. Together, first section length 154 and second section length 156 combine to reveal an inside edge length that is greater than first length 134 and second length 144 combined. Upper pipe 140 has a fastener hole 146 aligned with a diameter of upper pipe 140.

Lower pipe 130 has a fastener hole 136 through a diameter of lower pipe 130. Blade 102 has a step 128 between first section 118 and second section 122. Blade 103 has a step 129 between first section 119 and second section 123. Step 128 is substantially perpendicular to first section 118 and second section 122 on blade 102. Step 129 is substantially perpendicular to first section 119 and second section 123 on blade 103.

Blade 102 has lower end 110 that tapers to a point 116 proximal to inside edge 112. Blade 103 has lower end 111 that tapers to a point 117 proximal to inside edge 113.

Figure 2:
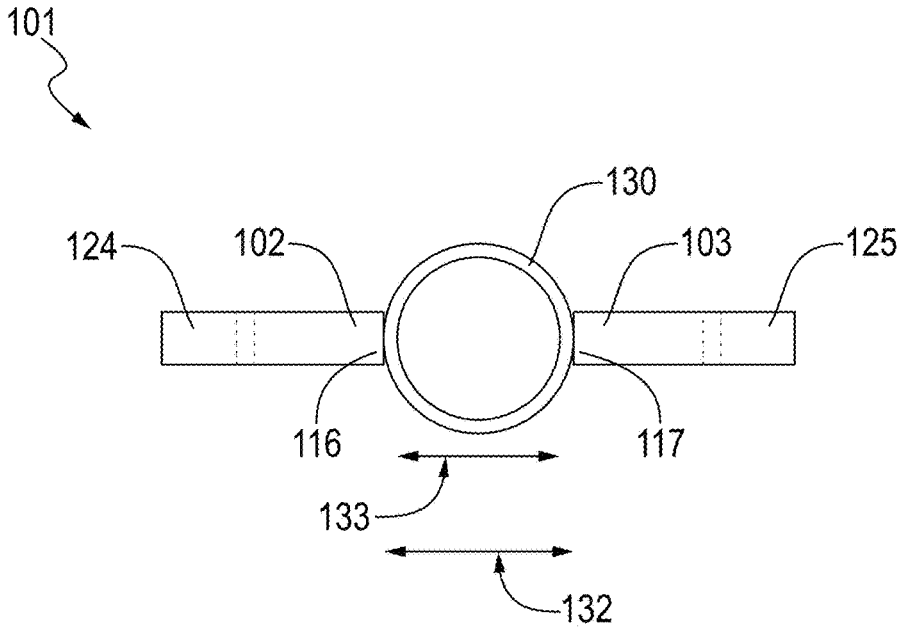
FIG. 2 depicts a bottom plan view of bit assembly 101.

FIG. 2 depicts a bottom plan view of bit assembly 101. For simplicity, upper pipe 140 is not shown in this figure. Lower pipe 130 has a first inner diameter 133 that is less than first outer diameter 132. Blade 102 and blade 103 are welded to lower pipe 130. Also visible are teeth 124, 125.

Figure 3:
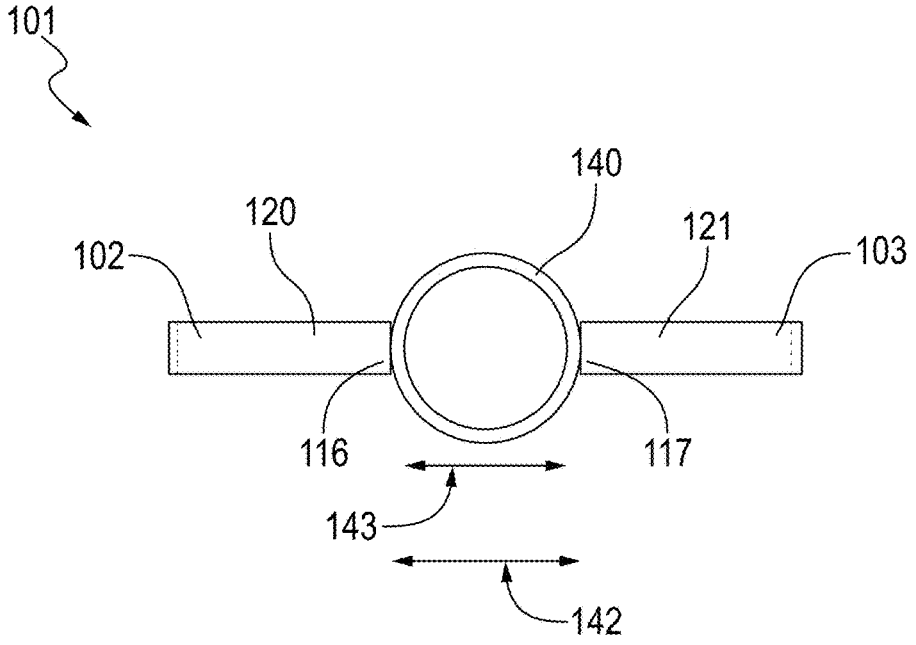
FIG. 3 depicts a top plan view of bit assembly 101.

FIG. 3 depicts a top plan view of bit assembly 101. For simplicity, lower pipe 130 is not shown in this figure. Upper pipe 140 has a second inner diameter 143 that is less than second outer diameter 142. Blade 102 and blade 103 are welded to upper pipe 140.

Figure 4:
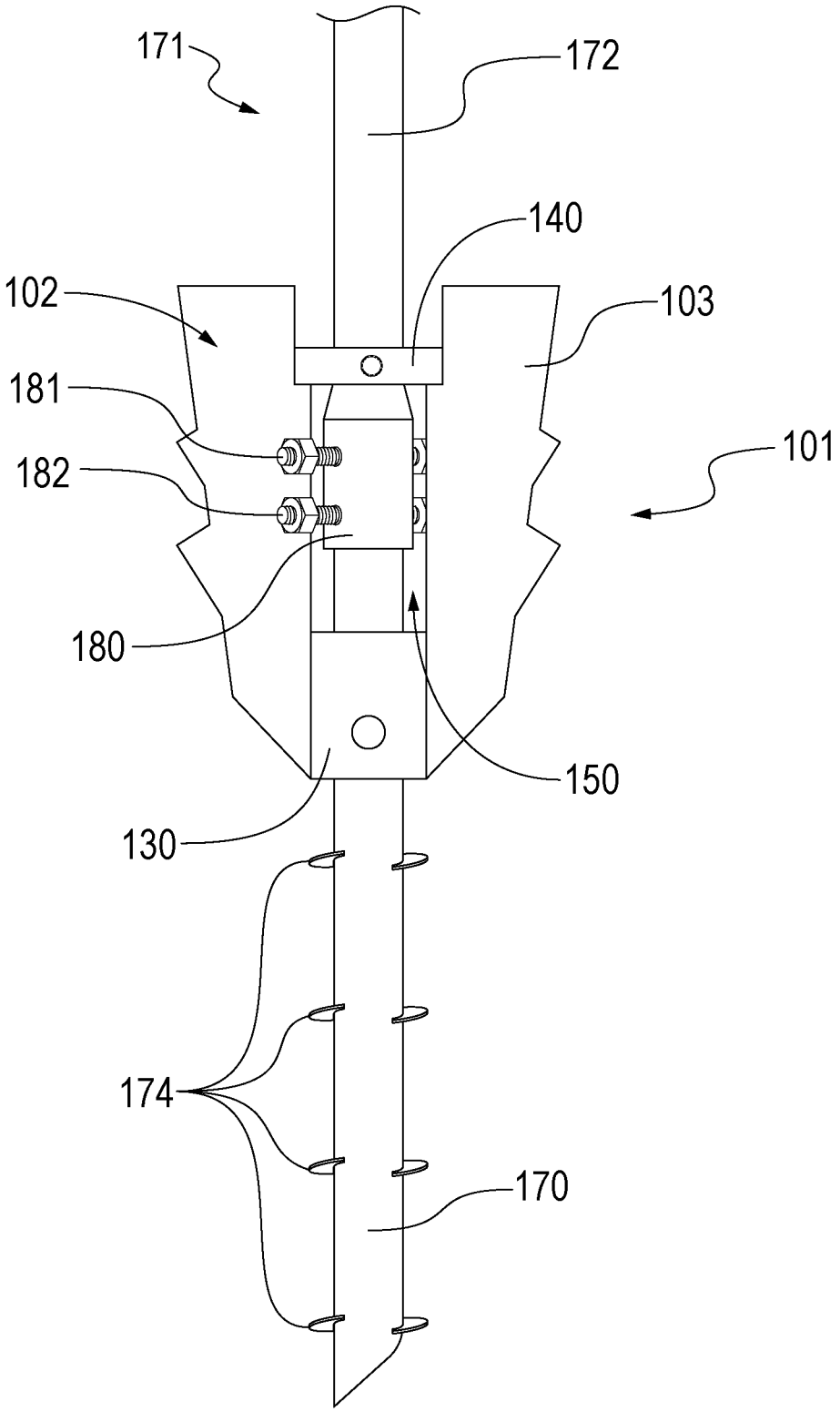
FIG. 4 shows a side elevation of bit assembly 101 with lead section 170 and first extension section 172.

FIG. 4 shows a side elevation of bit assembly 101 with lead section 170 and first extension section 172 of a pile 171. The lower end of extension section 172 has a coupling jacket 180 that fits over the top end of lead section 170. Driving fasteners 181, 182 pass through coupling jacket 180 add the top end of lead section 170, joining extension section 172 and lead section 170. Driving fasteners 181, 182 are positioned in the gap 150 of bit assembly 101, so that driving fasteners 181, 182 will contact at least one of blades 102, 103 when extension section 172 and lead section 170 are rotated. That will cause bit assembly 101 to rotate, causing blades 102, 103 to engage soil (not shown) around bit assembly 101. Lead section 170 has a flight of helical threads 174 that help pull lead section 170 down into the soil when lead section 170 is rotated counterclockwise in contact with that soil.

Figure 5:
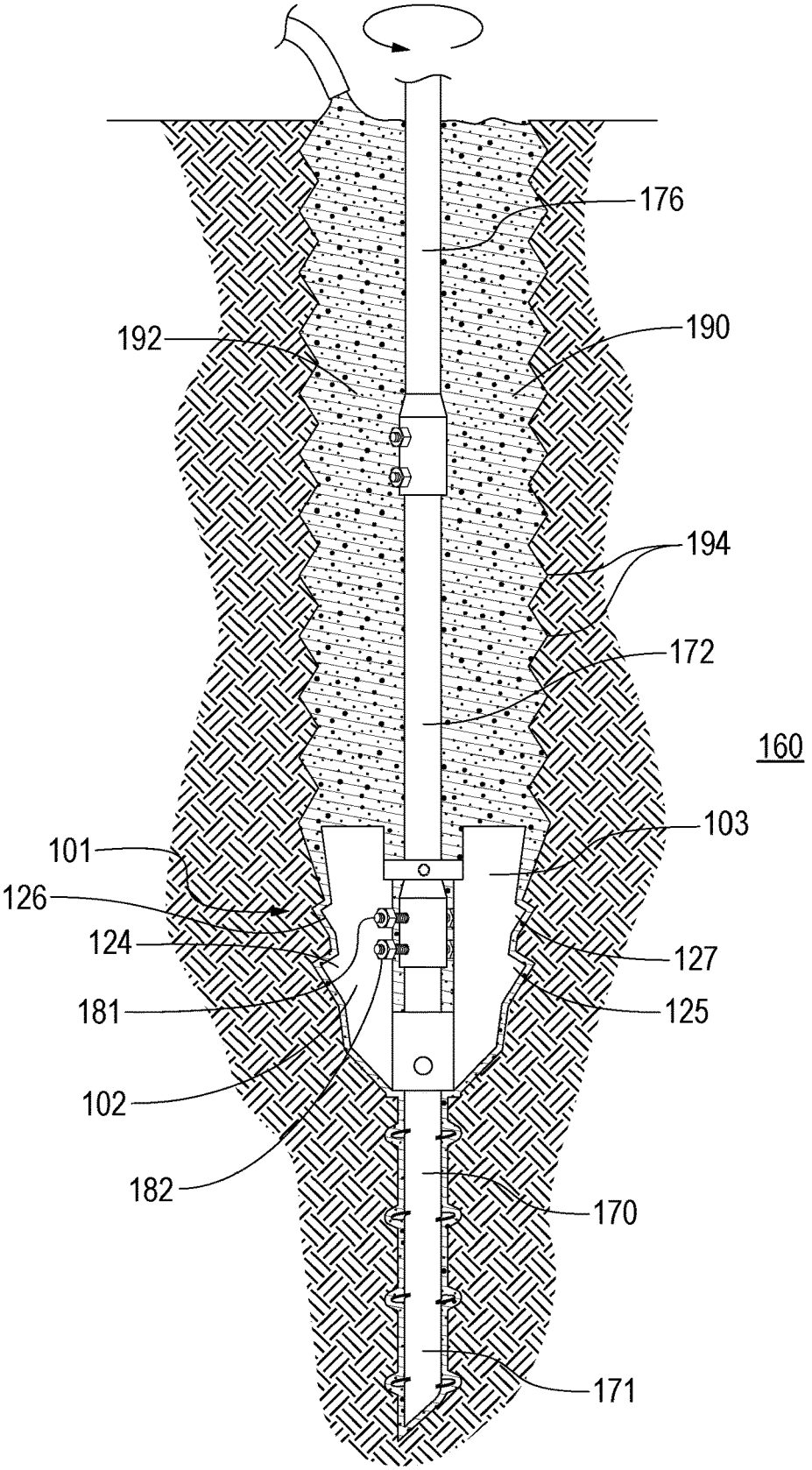
FIG. 5 shows hole 190 formed by lead section 170 with bit assembly 101.

FIG. 5 shows hole 190 formed by lead section 170 with bit assembly 101. Second extension section 176 is connected with first extension section 172, and both are driven by machinery connected to second extension section 176 (not shown). First extension section 172 is connected to lead section 170 in the gap 150 of bit assembly 101. Driving fasteners 181, 182 contact blade 102 and blade 103 to turn them through soil 160 to form hole 190 in soil 160. As teeth 124, 126 of blade 102, and teeth 125, 127 of blade 103 engage soil 160, grooves 194 are formed in soil 160 at the edge of hole 190. Liquid grout 192 is poured into hole 190 as lead section 170 is driven into soil 160, deepening hole 190. Once lead section 170 is driven to a desired depth, and sufficient grout 192 has been added, the machinery will be removed and the grout allowed to harden, thereby establishing a pile with bit assembly 101 in soil 160.

Clauses

The invention can be further understood by reference to the several clauses that follow.

Clause 1. a bit assembly for a construction pile comprising:

a plurality of blades;

a lower pipe securing each blade in the plurality of blades;

an upper pipe also securing each blade in the plurality of blades;

wherein the lower pipe and the upper pipe define a gap between them suitable for at least one blade in the plurality of blades to engage one or more driving fasteners of the construction pile.

Clause 2. A bit assembly for a construction pile comprising:

a plurality of blades, each blade comprising a lower end opposite an upper end;

an inside edge between the lower end and the upper end;

and an outside edge opposite the inside edge;

wherein the inside edge has a first section proximal to the lower end, and a second section proximal to the upper end;

the outside edge having at least one tooth;

a lower pipe having a first outer diameter securing each blade in the plurality of blades proximal to the lower end and at the first section of the inside edge;

an upper pipe having a second outer diameter securing each blade in the plurality of blades proximal to the upper end and at the second section of the inside edge;

wherein the lower pipe and the upper pipe define a gap between them suitable for at least one blade in the plurality of blades to engage one or more driving fasteners of the construction pile.

Clause 3. The bit assembly of any one of the preceding clauses, wherein the plurality of blades consists of two blades.

Clause 4. The bit assembly of any one of the preceding clauses, wherein the first outer diameter is less than the second outer diameter.

Clause 5. The bit assembly of any one of the preceding clauses, wherein the first outer diameter is about 3.5 inches.

Clause 6. The bit assembly of any one of the preceding clauses, wherein the second outer diameter is about 4.5 inches.

Clause 7. The bit assembly of any one of the preceding clauses, wherein the lower pipe has a first length; the upper pipe has a second length, and the inside edge of the blade has an inside edge length that is greater than the first length and the second length combined.

Clause 8. the bit assembly of clause 7, wherein the first length is about 4 inches.

Clause 9. The bit assembly of any one of clauses 7-8, wherein the second length is about 1 inch.

Clause 10. The bit assembly of any one of clauses 7-9, wherein the inside edge length is about 15 inches.

Clause 11. The bit assembly of any one of the preceding clauses, wherein the first section has a first section length of about 12 inches.

Clause 12. The bit assembly of any one of the preceding clauses, wherein the second section has a second section length of about 3 inches.

Clause 13. The bit assembly of any one of the preceding clauses, wherein the lower pipe has at least one fastener hole through a diameter of the lower pipe.

Clause 14. The bit assembly of any one of the preceding clauses, wherein the upper pipe has at least one fastener hole through a diameter of the upper pipe.

Clause 15. The bit assembly of any one of the preceding clauses, wherein the at least one tooth consists of two teeth.

Clause 16. The bit assembly of any one of the preceding clauses, wherein the at least one tooth appears on the outside edge opposite the first section of the inside edge.

Clause 17. The bit assembly of any one of the preceding clauses, wherein the lower end of each blade in the plurality of blades tapers to a point proximal to the inside edge.

Clause 18. The bit assembly of clause 17, wherein the lower end begins to taper to the point about 2.5 inches from the point.

Clause 19. The bit assembly of any one of the preceding clauses, wherein the lower pipe has a first inner diameter, and the upper pipe has a second inner diameter;

wherein the first inner diameter and the second inner diameter are both large enough to receive the construction pile within the lower pipe and the upper pipe.

Clause 20. The bit assembly of any one of the preceding clauses, wherein the lower pipe and the upper pipe are coaxial.

Clause 21. A method of manufacturing a bit assembly, comprising: obtaining a plurality of blades, each blade in the plurality of blades comprising a lower end opposite an upper end;

an inside edge between the lower end and the upper end;

and an outside edge opposite the inside edge;

obtaining a lower pipe having a first outer diameter, a first inner diameter, and a first length;

obtaining an upper pipe having a second outer diameter, a second inner diameter, and a second length;

attaching each blade in the plurality of blades at the inside edge proximal to the lower end to the lower pipe; and at the inside edge proximal to the upper end to the upper pipe;

thereby manufacturing the bit assembly.

Clause 22. The method of clause 21, wherein the bit assembly is the bit assembly of any one of clauses 1-20.

Clause 23. A blade for a bit assembly for a construction pile, the blade comprising:

a lower end opposite an upper end;

an inside edge between the lower end and the upper end;

and an outside edge opposite the inside edge;

the outside edge having at least one tooth.

Clause 24. The blade of clause 23, wherein the inside edge has a first section proximal to the lower end, and a second section proximal to the upper end; further comprising a step between the first section and the second section.

Clause 25. The blade of clause 24, wherein the step is substantially perpendicular to the first section and the second section.

Clause 26. The blade of any one of clauses 24-25, wherein the step defines a step distance between the first section and the second section.

Clause 27. the blade of clause 26, wherein the step distance is about half an inch.

Clause 28. A method for constructing a pile with a bit assembly, comprising:

obtaining the bit assembly comprising a plurality of blades, each blade comprising a lower end opposite an upper end;

an inside edge between the lower end and the upper end;

and an outside edge opposite the inside edge;

a lower pipe having a first outer diameter securing each blade in the plurality of blades proximal to the lower end and at the inside edge;

an upper pipe having a second outer diameter securing each blade in the plurality of blades proximal to the upper end and at the inside edge;

wherein the lower pipe and the upper pipe define a gap between them suitable for at least one blade in the plurality of blades to engage one or more driving fasteners of the construction pile;

placing a first part of the pile into the bit assembly through the lower pipe;

placing a second part of the pile into the bit assembly through the upper pipe;

joining the first part of the pile with the second part of the pile with the one or more driving fasteners at the gap, thereby constructing the pile with the bit assembly.

Clause 29. The method of clause 28, wherein the first part of the pile is a lead section.

Clause 30. The method of any one of clauses 28-29, wherein the second part of the pile is an extension section.

Clause 31. The method of any one of clauses 28-30, wherein the one or more driving fasteners comprise nuts and bolts.

Clause 32. The method of any one of clauses 28-31, wherein the first part has a top end having a top end outer diameter;

the second part comprises a bottom end having a bottom end inner diameter; and wherein the bottom end inner diameter is wider than the top end outer diameter.

Clause 33. The method of clause 32, wherein the top end outer diameter is about 2 and ⅞ inches.

Clause 34. The method of any one of clauses 32-33, wherein the bottom end of the second part has a bottom end inner diameter that is less than about 4 inches.

Clause 35. a pile in soil comprising:

a bit assembly comprising:

a plurality of blades, each blade comprising a lower end opposite an upper end;

an inside edge between the lower end and the upper end;

and an outside edge opposite the inside edge;

a lower pipe having a first outer diameter securing each blade in the plurality of blades proximal to the lower end and at the inside edge;

an upper pipe having a second outer diameter securing each blade in the plurality of blades proximal to the upper end and at the inside edge;

wherein the lower pipe and the upper pipe define a gap between them suitable for at least one blade in the plurality of blades to engage one or more driving fasteners of the construction pile.

Clause 36. The pile of clause 35, wherein the bit assembly is the bit assembly of any one of clauses 1-20.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A bit assembly for a construction pile, the bit assembly comprising:

a plurality of blades, each blade comprising a lower end opposite an upper end;

an inside edge between the lower end and the upper end;

and an outside edge opposite the inside edge;

wherein the inside edge has a first section proximal to the lower end, and a second section proximal to the upper end;

a lower pipe having a first outer diameter securing each blade in the plurality of blades proximal to the lower end and at the first section of the inside edge;

an upper pipe having a second outer diameter securing each blade in the plurality of blades proximal to the upper end and at the second section of the inside edge;

wherein the lower pipe and the upper pipe define a gap between them suitable for at least one blade in the plurality of blades to engage one or more driving fasteners of the construction pile;

wherein the lower pipe has at least one fastener hole aligned with a diameter of the lower pipe.

2. The bit assembly of claim 1, wherein the outside edge of each blade in the plurality of blades comprises at least one tooth.

3. The bit assembly of claim 2, wherein the at least one tooth consists of two teeth.

4. The bit assembly of claim 2, wherein the at least one tooth appears on the outside edge opposite the first section of the inside edge.

5. The bit assembly of claim 1, wherein the plurality of blades consists of two blades.

6. The bit assembly of claim 1, wherein the first outer diameter is less than the second outer diameter.

7. The bit assembly of claim 1, wherein the first outer diameter is about 3.5 inches.

8. The bit assembly of claim 1, wherein the second outer diameter is about 4.5 inches.

9. The bit assembly of claim 1, wherein the lower pipe has a first length; the upper pipe has a second length, and the inside edge of the blade has an inside edge length that is greater than the first length and the second length combined.

10. The bit assembly of claim 9, wherein the first length is about 4 inches.

11. The bit assembly of claim 9, wherein the second length is about 1 inch.

12. The bit assembly of claim 9, wherein the inside edge length is about 15 inches.

13. The bit assembly of claim 1, wherein the first section has a first section length of about 12 inches.

14. The bit assembly of claim 1, wherein the second section has a second section length of about 3 inches.

15. The bit assembly of claim 1, wherein the upper pipe has at least one fastener hole aligned with a diameter of the upper pipe.

16. The bit assembly of claim 1, wherein the lower end of each blade in the plurality of blades tapers to a point proximal to the inside edge.

17. The bit assembly of claim 16, wherein the lower end begins to taper to the point about 2.5 inches from the point.

18. The bit assembly of claim 1, wherein the lower pipe has a first inner diameter, and the upper pipe has a second inner diameter;

wherein the first inner diameter and the second inner diameter are both large enough to receive the construction pile within the lower pipe and the upper pipe.

19. The bit assembly of claim 1, wherein the lower pipe and the upper pipe are coaxial.

* * * * *